US006975739B2

(12) United States Patent
Bogason et al.

(10) Patent No.: US 6,975,739 B2
(45) **Date of Patent: *Dec. 13, 2005**

(54) HEARING AID WITH A RADIO FREQUENCY RECEIVER

(75) Inventors: Gudmundur Bogason, Hellerup (DK); Bjarne Klemmensen, Hellerup (DK)

(73) Assignee: Oticon A/S, Hellerup (DK)

( * ) Notice: Subject to any disclaimer, the term of this patent is extended or adjusted under 35 U.S.C. 154(b) by 155 days.

This patent is subject to a terminal disclaimer.

(21) Appl. No.: 10/381,693

(22) PCT Filed: Oct. 4, 2001

(86) PCT No.: PCT/DK01/00647

§ 371 (c)(1),
(2), (4) Date: Mar. 27, 2003

(87) PCT Pub. No.: WO02/30153

PCT Pub. Date: Apr. 11, 2002

(65) Prior Publication Data

US 2004/0096076 A1 May 20, 2004

(30) Foreign Application Priority Data

Oct. 4, 2000 (DK) ..... 2000 01477

(51) Int. Cl.[7] ..... H04R 25/00
(52) U.S. Cl. ..... 381/315; 381/314; 381/322; 381/323
(58) Field of Search ..... 381/23.1, 312, 381/314–316, 320–324, 330; 455/150.1, 455/154.1, 154.2, 161.1, 161.3, 260, 264, 455/265, 255, 76

(56) References Cited

U.S. PATENT DOCUMENTS

| | | | | |
|---|---|---|---|---|
| 4,088,959 A | | 5/1978 | Sumi | |
| 4,538,136 A | | 8/1985 | Drabing | |
| 5,721,783 A | * | 2/1998 | Anderson | 381/328 |
| 5,751,820 A | * | 5/1998 | Taenzer | 381/312 |
| 5,802,183 A | | 9/1998 | Scheller et al. | |
| 6,240,194 B1 | | 5/2001 | De Koning | |

FOREIGN PATENT DOCUMENTS

| | | | |
|---|---|---|---|
| CH | 6863330 | | 2/1996 |
| EP | 0578020 | * | 1/1994 |
| WO | 8404637 | | 11/1984 |

* cited by examiner

*Primary Examiner*—Huyen Le
(74) *Attorney, Agent, or Firm*—Dykema Gossett PLLC

(57) ABSTRACT

A hearing aid includes a signal path having an input transducer, a processor and an output transducer, the hearing aid further including a radio frequency receiver, where the receiver includes a single crystal oscillator providing a single oscillator frequency and where means are provided for generating a further number of receiving frequencies by transforming the oscillator frequency to the desired receiving frequencies. The hearing aid and the RF receiver may be separate or integrated. The invention further relates to a separate element comprising a RF receiver, the separate element being adapted for mounting on a hearing aid.

4 Claims, 4 Drawing Sheets

HEARING AID WITH A RADIO FREQUENCY RECEIVER

AREA OF THE INVENTION

The invention relates to the area of hearing aids comprising a radio frequency receiver. The receiver may be a built in receiver or an external receiver attached to the hearing aid by suitable means.

BACKGROUND OF THE INVENTION

It is well known to provide a RF receiver in connection with a hearing aid. Such systems are often used in education situations where a hearing impaired student wearing a hearing aid receives a teachers voice through a RF transmission equipment. Where such systems are used in adjacent classrooms the transmission frequency must be different in the respective classroom in order to ensure receipt of the correct signal by the student.

One example of a hearing aid with a RF receiver is disclosed in CH 641619. The hearing aid with an RF receiver shown in this prior art document and other similar products available on the market today all comprise a single frequency receiving possibility. From U.S. Pat. No. 5,802,183 a further hearing aid is known which comprises the possibility of shifting between two frequencies, due to the presence of two crystals for determining the receiving frequency. In all of these previously known devices the frequency may be changed by changing the crystal element present for determining the receiving frequency. The very limited space available in such devices makes it difficult and often even impossible to incorporate a number of crystals corresponding to the desired receiving frequencies.

The change of a crystal is rather difficult due to the small size of these elements and the process is rather time consuming. Furthermore an amount of crystals corresponding to the number of desired frequencies is required for making the system operative under all desired circumstances. The device known from U.S. Pat. No. 5,802,183 offers the possibility of having two crystals and a switch for switching between the two frequencies. When however a larger number of frequencies is desired the same problem as described above exists.

The objective of the present invention is to provide a device, which offers the possibility of shifting between a larger number of frequencies than previously known, in a more efficient and less time consuming manner. A further objective is to provide a separate unit, which in connection with a hearing aid provides these same advantages.

SUMMARY OF THE INVENTION

The first objective of the invention is achieved by means of a hearing aid as defined in claim 1.

By means of the defined construction it is possible to realize an increased number of possible receiving frequencies in the very limited available space of a hearing aid. The selection of the desired receiving frequency may be achieved simply by tuning into the frequency by means of suitable selector means.

Advantageous embodiments are defined in claims 2–4.

By the embodiment in claim 2 a possibility of adding a receiver with multiple frequencies to an existing hearing aid is achieved. The control of the channel selection may be achieved by the hearing aid control means, however since these may not be adapted for this purpose the providing of a channel selection means on the separate unit will be further advantageous.

By integrating the receiver in the hearing aid as defined in claim 3 a possibility of saving space compared to the external device and at the same time provide for multiple frequency selection. The selection means are advantageously integrated in the housing and the possibility of using existing switches and selection means for channel selection is further advantageous.

By passing the RF signal through the digital interface on the HA, as defined in claim 4, the frontend of the hearing aid can be bypassed. This means that signal-to-noise ratio is not lost in the first critical analog blocks. Besides this, the digital interface increases the flexibility in signal treatment compared to the traditional input parallel to the microphone. The signal level can easily be adjusted to fit the microphone input, and if needed different frequency characteristics can be applied.

The second objective is achieved by means of a unit as defined in claim 5.

By means of the defined construction it is possible to realize an increased number of possible receiving frequencies in a very limited available space when the unit is mounted on the hearing aid. The selection of the desired receiving frequency may be achieved simply by tuning into the frequency by means of suitable selector means, e.g. a push button activated frequency selector electronics.

By the embodiment of claim 6 a possibility of passing the RF signal through the digital interface on the hearing aid is obtained, and the frontend of the hearing aid can be bypassed. This provides the same advantages as mentioned above in connection with claim 4.

The radio frequency signal is preferably a FM signal. Hereby the receiver comprises suitable demodulator means for regenerating the original signal.

The invention is explained more detailed in the description of a preferred embodiment, with reference to the drawings.

DESCRIPTION OF A PREFERRED EMBODIMENT

Figure 1:
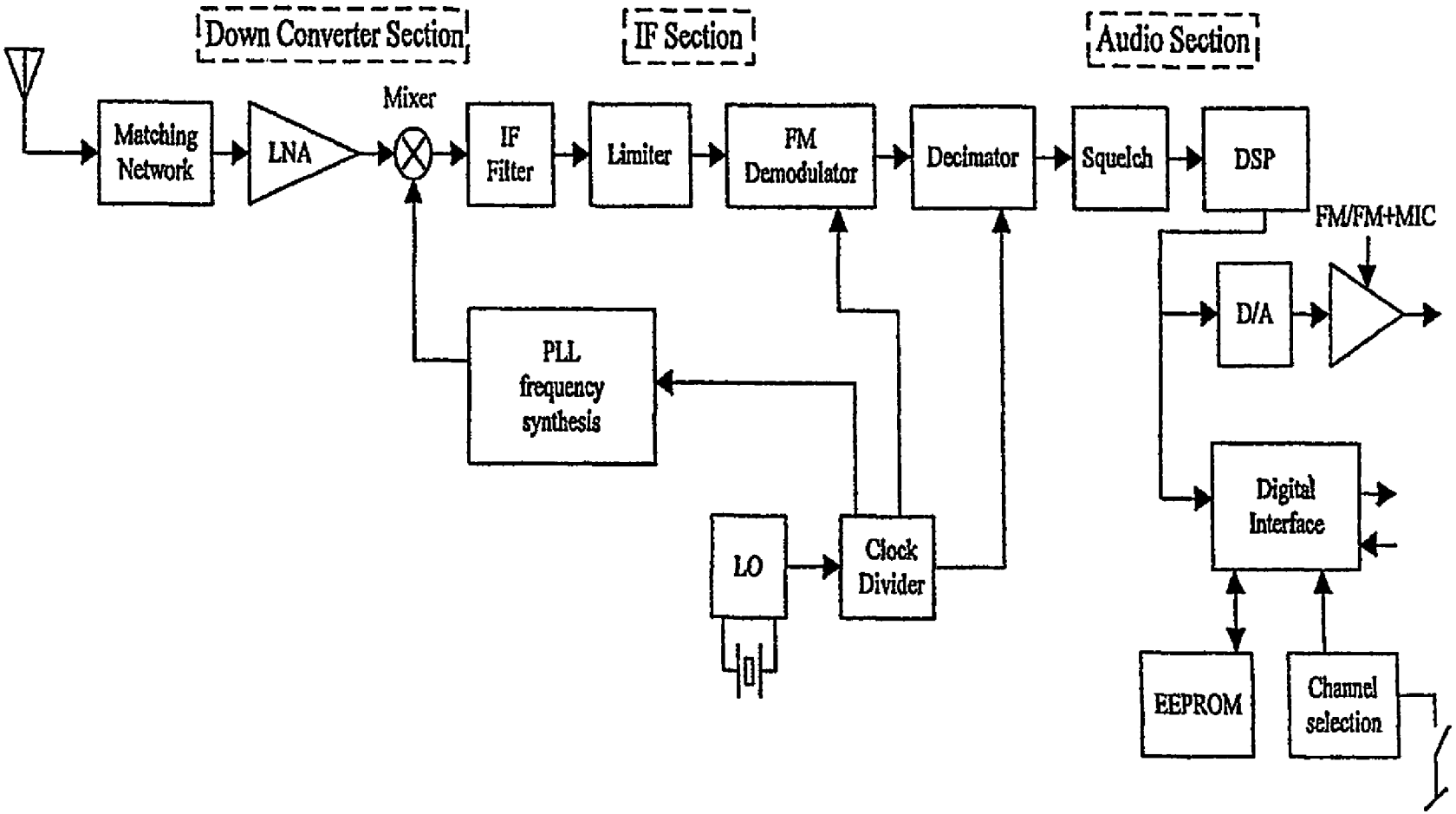
FIG. 1 is a simplified circuit diagram showing a module intended for connection to a hearing aid.

Referring to FIG. 1 the analog RF signal, preferably a FM signal, is picked up by an antenna, which is connected to the on-chip LNA through an external matching network. The matching network is needed to make the FM receiver flexible towards different types of antennas, and to keep the current consumption down in the LNA.

The LNA (Low Noise Amplifier) is used to amplify the weak signal, which is picked up on the antenna. Low noise is essential due to the low signal level at the input. The LNA wires the signal on to the mixer, which as the second input gets the desired channel frequency from the frequency synthesizer. The frequency synthesis system is described further in connection with FIG. 2.

The mixer mixes the signal down to an intermediate frequency (IF) of 35 KHz, which is the lowest intermediate frequency acceptable with the given audio bandwidth and frequency deviation. To support the wide range of synthesisable frequencies, the mixer and LNA needs wide operating conditions with regards to input frequencies.

The IF filter is used to separate the wanted channel. A steep filter is needed to obtain the wanted selectivity and properly suppress undesired signal in adjacent channels. Following the IF filter the limiter is the block with most of the gain. The IF signal is boosted and the analog signal is transformed to digital signal levels using a hard-clipping comparator.

The fully digital demodulator is based on a time detection scheme, which detects the zero-crossing of the IF signal. The demodulator is followed by a decimator that transforms the high frequency single bit signal to a 12 bit signal at a sampling frequency of 24 kHz. All signal processing of the demodulated signal is made by use of digital signal processing.

Two output solutions are available from the audio section. For older hearing aid (HA) styles, the audio signal is applied to the on-chip AD converter, and a traditional HA accessory interface system with output impedance adjustment is used to control the output level of the FM receiver.

For new advanced hearing aids, the receiver offers a fully digital audio output, and thereby a fully digital interface between the two systems. The interface is controlled by a derived IIC protocol, which is a true two-wire protocol. By transferring the audio and control signals digital, we get a much more reliable connection. In general, a digital interface is much less sensitive to bad contacts, noise, hum, moisture, dirt etc.

By passing the demodulated RF signal through the digital interface on the HA, the frontend can be bypassed. This means that signal-to-noise ratio is not lost in the first critical analog blocks. Besides this, the digital interface increases the flexibility in signal treatment compared to the traditional input parallel to the microphone. The signal level can easily be individually adjusted to fit the microphone input, and if needed different frequency characteristics can be applied.

Figure 2:
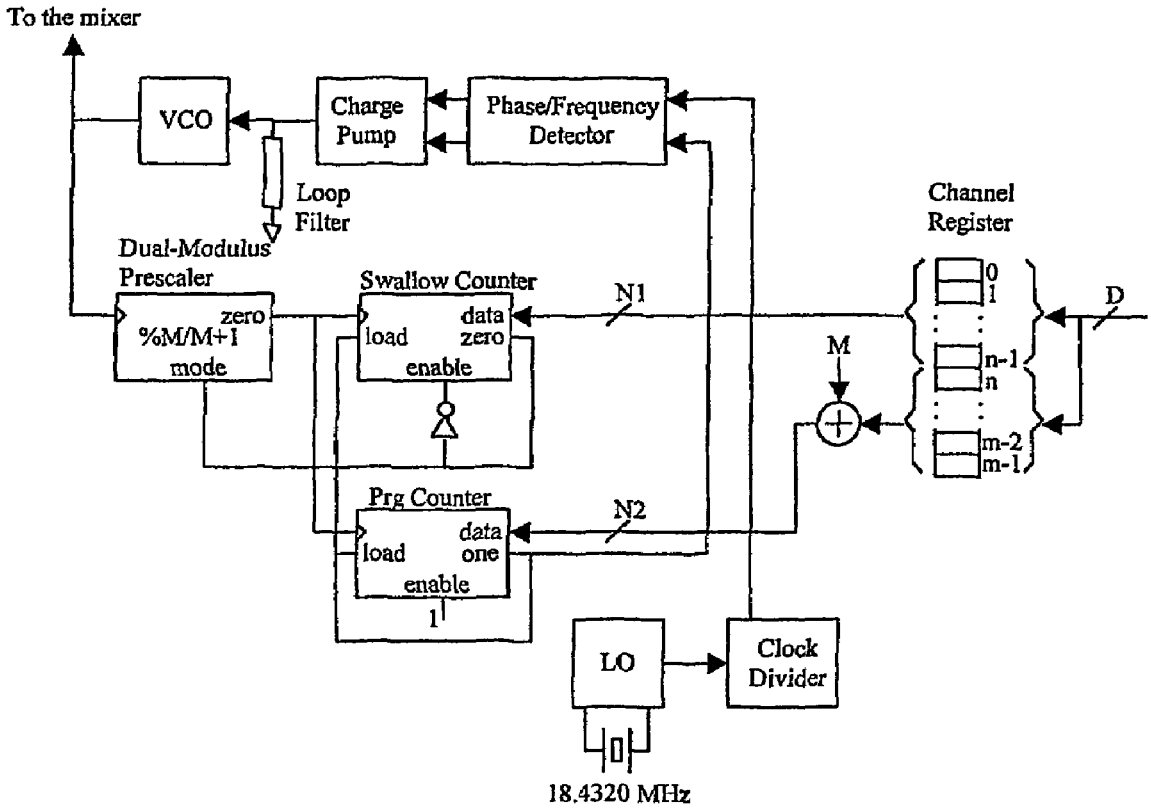
FIG. 2 is a simplified circuit diagram showing the frequency synthesizer part of the module of FIG. 1.

By adding frequency synthesis, as described more detailed in FIG. 2, the user will only need one crystal, which is mounted at the factory. Within the given frequency bands the user chooses the pre-programmed channels via the channel selection interface. In other words the user has access to more than one channel without changing crystal, and the logistics are eased with only one version per band instead of having one crystal per channel.

The frequency synthesis will enable the use of the RF receiver in more applications than today: Stadiums, concert halls, churches etc. At a conference the user will be able to e.g. switch between different languages by changing channel, and if the system is used one on one, the user can change channel to avoid annoying interference, which might prove useful at e.g. dinner parties or other situation where a separate microphone unit is used, which transmits to the hearing aid.

The frequency synthesis is built around a traditional phase locked loop (PLL). The wanted channel is set up using a 16 bit digital code, which is loaded from the attached EEPROM. Depending of the used reference frequency, the step size, and thereby the range and accuracy can be adjusted. With e.g. a 5 kHz step size, the range from 70 to 250 MHz is covered using only one crystal.

The VCO generates the high frequency waveform needed to match the wanted channels. The output frequency is controlled by a control voltage, which is generated by an attached charge pump. To obtain the needed accuracy the charge pump has a built-in voltage multiplier, which is used to widen the control voltage range. The control voltage and thereby the frequency is stepped up and down by the phase/frequency detector. The detector compares the divided output with the reference frequency (which determines the step size).

Depending on the applied control word, different start values are set up in the counters in the dividers. According to these values the division ratio is adjusted to obtain the wanted frequency (channel). For high frequencies the division ratio needs to be high to obtain the stable situation when the input for the phase/frequency detector matches the reference frequency locking the PLL.

The frequency synthesis makes it possible for the user to change channel without changing crystal. The user channel selection is done by use of a push button. The simplest use of a push button is a sequence of channels, where the next channel is chosen by a push. Another use of the push button solution is auto search. When the button is pushed, the pre-programmed channels are flicked through looking for activity. The first available channel, with enough signal strength, is then chosen. If more channels fulfil the demands, this function will switch between these when the button is pushed.

Figure 4:
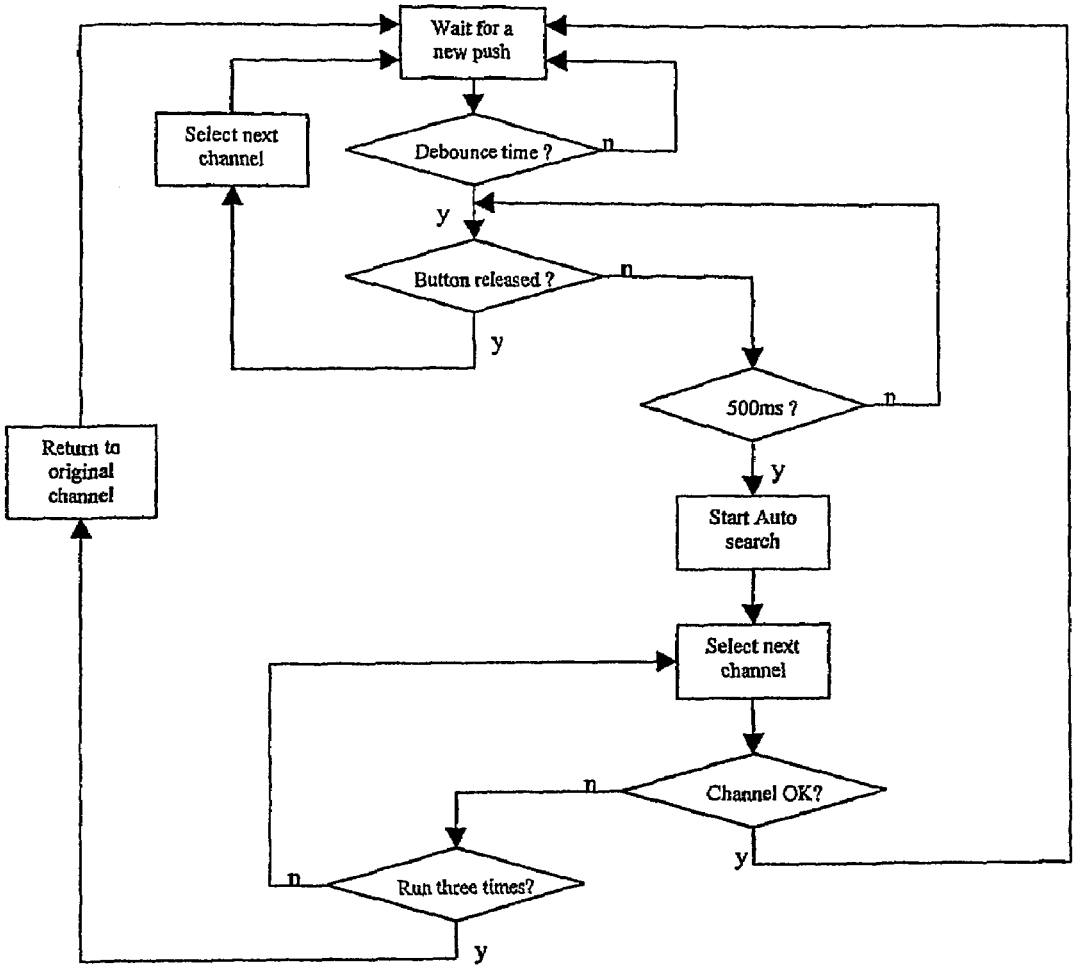
FIG. 4 is a diagram showing the implementation of the selector facility.

The two push button functions are easily combined. This is depicted in FIG. 4. A short push will choose the next channel, whereas a long push will enable the auto search. This combination is well known from e.g. car radios. At power up the device will remember the latest used channel.

The user interface can be disabled for fixed channel devices and the two push button functions can be enabled/disabled independently. To enable a new search, the button must be released and pushed again. If no channels are found, the auto search routine will stop after three passes.

When a short push is detected, the switch interface sends a request for the EEPROM controller to change channel. This is done once for every push. When the auto search is enabled, the same request is send to the controller, but when the next channel is selected, a check is made to see, if this channel lives up to the required signal strength. The squelch circuit is used for the auto search criteria. If the selected channel is "squelched", a new request is sent, and the next channel in line is selected. This is done until an active channel is found, or until the channel sequence has been tested three times. A separate squelch level is used for the auto search to refine the search criteria.

When a new channel code is read in the EEPROM, this address is at the same time written to the ROM as being the active channel. This is necessary for the memory of latest used channel.

Figure 3:
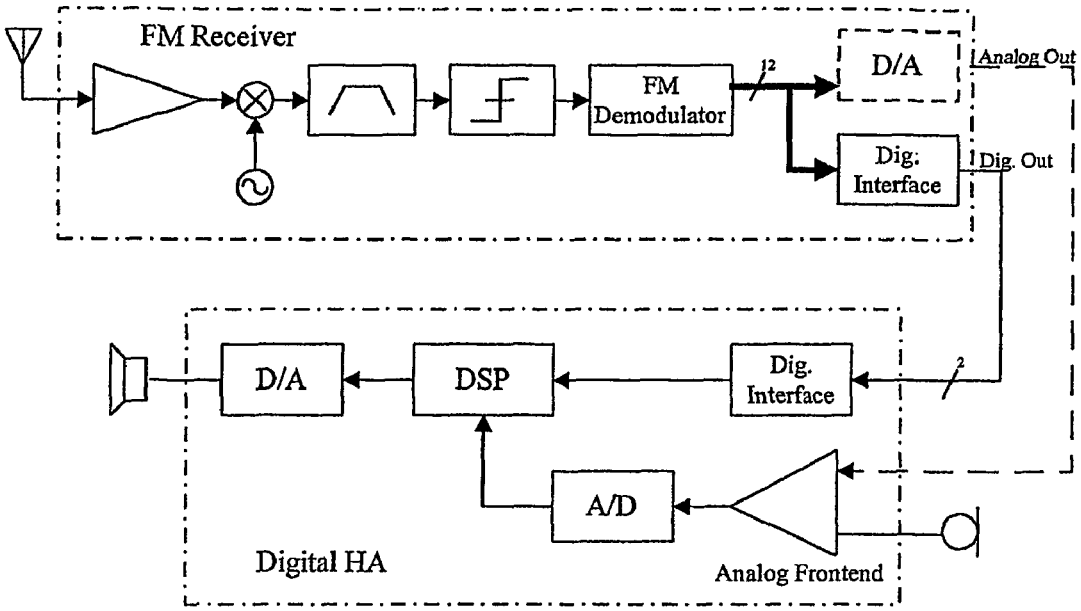
FIG. 3 is a simplified circuit diagram showing the interface between a module as shown in FIG. 1 with a hearing aid.

By passing the FM signal through the digital interface on the HA, the frontend can be bypassed. This is depicted in FIG. 3. This means that we won't loose signal-to-noise ratio in the first critical analog blocks. Besides this, the digital interface increases the flexibility in signal treatment compared to the traditional input parallel to the microphone. The signal level can easily be adjusted to fit the microphone input, and if needed different frequency characteristics can be applied.

The circuit is powered by a energy source, e.g. a battery that powers the hearing aid.

What is claimed is:

1. A hearing aid comprising a signal path having an input transducer, a processor, an analog-to-digital converter, and an output transducer, the hearing aid further comprising a radio frequency receiver for generating a digital audio signal that is lead to the signal path downstream of the analog-to-digital converter, wherein the radio frequency receiver comprises a single crystal oscillator providing a single oscillator frequency and wherein means are provided for generating a further number of receiving frequencies by transforming the oscillator frequency to the desired receiving frequencies, and including a selector means for selecting a desired frequency.

2. A hearing aid according to claim 1, wherein the radio frequency receiver is mounted as a separate element on the hearing aid.

3. A hearing aid according to claim 1, wherein the radio frequency receiver is integrated in the hearing aid.

4. A unit for mounting on a hearing aid, the unit comprising a radio frequency receiver for generating a digital signal and to transmitting the digital signal to the hearing aid, wherein the receiver comprises a single crystal oscillator providing a single oscillator frequency and wherein means are provided for generating a further number of receiving frequencies, and wherein the unit comprises contact elements adapted for engagement with corresponding contact elements on the hearing aid for transmission of a signal from the element to the hearing aid.

* * * * *